US005158929A

United States Patent [19]

Quella et al.

[11] Patent Number: 5,158,929

[45] Date of Patent: Oct. 27, 1992

[54] INKING RIBBON

[75] Inventors: Ferdinand Quella, Neubiberg; Wolfgang Pekruhn, Berlin; Oskar Nuyken, Munich; Hartmut Grethen, Grethen; Barbara Dörner, Berlin, all of Fed. Rep. of Germany

[73] Assignee: Mannesmann AG, Fed. Rep. of Germany

[21] Appl. No.: 477,988

[22] PCT Filed: Oct. 28, 1988

[86] PCT No.: PCT/DE88/00668

§ 371 Date: Jun. 29, 1990

§ 102(e) Date: Jun. 29, 1990

[87] PCT Pub. No.: WO89/03772

PCT Pub. Date: May 5, 1989

[30] Foreign Application Priority Data

Oct. 29, 1987 [DE] Fed. Rep. of Germany ..... 3736728

[51] Int. Cl.[5] ..... B41M 5/035; B41M 5/26

[52] U.S. Cl. ..... 503/227; 428/195; 428/212; 428/913; 428/914

[58] Field of Search ..... 428/195, 913, 914, 212; 503/227; 8/471

[56] References Cited

U.S. PATENT DOCUMENTS 4,619,665 10/1986 Sideman et al. ..... 8/402

OTHER PUBLICATIONS

Abstract from the Third International Conference on Unconventional Photoactive Solids, Oct. 11-15, 1987.

*Primary Examiner*—B. Hamilton Hess

*Attorney, Agent, or Firm*—Hill, Van Santen, Steadman & Simpson

[57] ABSTRACT

Inking ribbon for thermographic printers that contains constituents that can be decomposed thermally or by radiation, particularly constituents that decompose upon release of a gas. Given correspondingly manufactured inking ribbons, the color-transferring regions (decomposition regions) can be more sharply defined, the required heating capacity for printing can be reduced and a better color adhesion on paper is achieved.

10 Claims, No Drawings

INKING RIBBON

The invention is directed to an inking ribbon for a transfer printing process, whereby colorant components are transferred from a carrier film onto a material to be printed, particularly paper, due to designational action of radiation and/or heat.

Such printing processes are employed, for example, in thermographic printers. Printer inks for inking ribbons that are already known are composed of a wax that contains the colorant and a bonding agent. This wax is applied on a carrier that is usually composed of a flexible plastic film, for example of polybutylene terephthalate. An aluminum layer can also be present between the film and wax layer for better thermoconduction. The inking ribbons for the printers are manufactured from films coated in this way.

In the printing process that is also referred to as release technique, a printing head that, for example, can be composed of a plurality of heatable elements arranged in the form of a matrix, transfers a defined quantity of heat onto the inking ribbon via these elements. As a result thereof, the wax is melted and is transferred onto the medium to be printed, particularly paper, by the pressure simultaneously applied. The wax layer that contains the colorant and is transferred onto the paper is thereby relatively thick. Although a good color saturation is achieved as a result thereof that is also independent of the surface of the paper, the adhesion of the colorant to the paper and, as a consequence, the resistance to abrasion is still capable of great improvement in this technology.

Given increasing printing speed, the multi-layer structure of the described inking ribbon is also disadvantageous. The wax layer must be melted during printing and therefore, just like all the other layers, consumes a certain heating capacity that limits the maximally obtainable printing speed. The mechanical stressing of the inking ribbons also only allows a certain printing speed.

Moreover, the "thermal efficiency" in thermographic printers having traditional printer ink compositions amounts to only about 5% based on a rough estimate. This means that about 95% of the heating capacity exerted is lost as dissipated heat and can no longer be directly utilized for the color transfer.

It is therefore an object of the present invention to specify an inking ribbon for transfer printing processes that exhibits a good color saturation on, for example, paper, improved printing quality given good color adhesion and high resistance to abrasion of the inking ribbon and that also requires less heating capacity for the color transfer.

This object is inventively achieved by an inking ribbon of the species initially cited in that at least the colorant is chemically bonded to or in a carrier phase on the carrier film in labile fashion, this chemically decomposing due to the action of radiation and/or heat, whereby this is converted into a mobile phase and is transferred onto the material to be printed. It also lies within the scope of the invention that, in the preliminary stage, the at least one releasable ink constituent or the colorant is bonded via a labile group upon whose decomposition a gaseous compound is also released in addition to the released in addition to the ink constituent. Further developments of the invention are provided by an inking ribbon in which at least one ink constituent in releasable by radiation and/or heat or the colorant is bonded in the carrier phase via a labile group upon whose decomposition a gaseous compound is additionally released. The inking ribbon has at least the colorant being chemically bonded to a carrier polymer in labile fashion. Such inking ribbon preferably has the carrier polymer simultaneously representing the carrier film of the inking ribbon.

The inking ribbon of the present invention provides that, given the chemical decomposition of the carrier phase, at least one ink constituent that is liquid under the given conditions is released that represents a solvent for the further ink constituents to be transferred. The inking ribbon includes the carrier phase being a polymer having a low depolymerization temperature which is obtained by polymerization of monomers of a plastic in the presence of an ink constitutent that at least comprises the colorant.

Additional developments provide that the carrier phase contains a labile group that is an azo group or carboxylate group. Two colorants which are releasable at different temperatures are provided in the carrier phase in another embodiment. Alternately, a further, thermally labile compound that releases at least one gas upon decomposition is provided on the carrier film. The further, thermally labile compound is preferably azodicarbonamide.

Due to the thermally labile chemical bonding of ink constituents in a non-mobile compound, the release of these ink constituents is facilitated. What is thereby to be understood by release and mobilization is the conversion of this ink constituent into a more mobile phase. This mobile phase can be liquid or can also be gaseous at the given temperature.

Releasable ink constituents and, thus, ink constituents transferable onto the material to be printed can be: one or more colorants or pigments, bonding material for the colorant, a "wax" used for an intermediate or cover layer and transferable after the melting or a liquid compound acting as solvent for other ink constituents in the released condition at the given temperature.

The transfer of the ink constituents of the inking ribbon of the invention requires a lower energy application than given traditional inking ribbons. Due to the chemical bonding of ink constituents in the invention, the covering wax layer on the inking ribbon can be executed thinner or can also be entirely eliminated.

A gas released during the printing event in an embodiment of the invention promotes the transfer of the ink constituent onto the medium to be printed. Due to the pressure arising upon release of the gas, the ink constituents are lent adequate kinetic energy in order to penetrate deeply into the material to be printed (for example, paper). An enhanced colorant adhesion on the paper is achieved as a result thereof.

This promoting, additional effect can also be achieved by mixing a further, thermally labile compound to the ink constituents. For example, azodicarbonamide represents such a compound acting as "driving agent". This compound that can be added to the ink constituents up to about 10% by weight is preferred since it releases no toxic gases. However, azo frothing agents can, for example, also be employed. The decomposition temperature can be set at approximately 80° C. with 2-t-butylazo-2'-cyanobutane. A driving agent that thermally splits off carbon dioxide in addition to nitrogen is 2, 2'-diacetoxy-2, 2'-azopropane.

Due to the chemical decomposition reaction on the inking ribbon, a faster color transfer is achieved (even without gas being thereby released) than is possible given traditional inking ribbons where the color transfer is achieved solely by melting a wax layer and by the exerted pressure. Further advantages are achieved particularly given a matching of the decomposition temperature of the labile compound to the melting point of the wax that may be present as cover layer. The speed of the transfer of the ink constituent rises suddenly and steeply in the inking ribbons of the invention when the decomposition temperature is reached and thus enables a sharper print format on, for example, paper.

Further, the colorant and further ink constituents can be bonded to a carrier polymer. In a preferred embodiment, this polymer simultaneously represents the carrier film for the inking ribbon. A multi-layer structure of the inking ribbon can therefore be eliminated in this case. Given an unaltered printing speed, the inking ribbon can now be executed noticeably thinner since the risk of mechanical damage to an inking ribbon having a single-layer format is considerably less during operation than in the case of a multi-layer structure. The amount of energy that is needed for color transfer is also reduced in this embodiment. In addition to a lower contribution for heating the film, only that heating capacity that is necessary for decomposing the labile groups must be exerted. The decomposition ranges, i.e. the ranges wherein a color transfer should occur, can be more sharply defined with the new printing ink than is possible with the traditional wax layer technique. A sharper print format is thus achieved, whereby the printing ink penetrates into the deepest paper cavities and pores, adheres correspondingly well and also yields a good ink coverage.

A further embodiment of the printer ink allows the transfer of the colorant constituents to be undertaken in solution. In addition, for example, to the constituent containing the colorant, other ink constituents can thereby also be bonded via labile groups or bonds to the carrier polymer or as a non-mobile compound, these forming a liquid phase upon decomposition and being capable of dissolving the ink constituents. Due to the transfer of the ink constituents in solution or in liquid phase, an even better penetration of the ink into pores and cavities of paper is achieved.

A further development of the idea of the invention is directed to an inking ribbon wherein at least one ink constituent is released from a depolymerizable polymer having a low decomposition temperature. Poly-$\alpha$-methylstyrol that has a ceiling temperature of about 61° is an example of this. In the simplest case, the bonding of the ink constituent, for example of the colorant in such polymers can ensue in that the polymerization is carried out in the presence of a colorant. The colorant is thereby enclosed in the polymer matrix of the plastic like a filler. It is better when colorants are utilized that carry a polymerizable, functional group and can serve as monomers for a co-polymerization with the depolymerizable plastic, so that the colorant is also chemically bonded to and into the polymer.

The selection of suitable colorants is large when the required conditions are met. For the embodiments of the invention that provide labile groups bonded to the colorant constituent, the azo group and the carboxylate group are available as labile groups that release the gases nitrogen or, respectively, carbon dioxide when they decompose. Both groups are easily accessible to the chemist and are accessible in a plurality of reactions. In part, the production of the labile group can be simultaneously employed with the linking reaction of the colorant constituent to the carrier polymer. For example, polyamines that carry free amino groups can be easily coupled to suitable colorants upon formation of azo groups.

Both the azo group as well as the carboxylate group decompose when heated, whereby the decomposition temperature can be set within certain limits by chemical modification, as known, for example, for foaming agents from an article by D. Braun in Monatshefte fuer Chemie 110, pages 699 through 713 (1979). On the basis of suitable modification, it is therefore also possible to incorporate different colorants into a carrier polymer such that they are released at different temperatures.

It is also fundamentally possible to trigger the printing event by the action of radiation. For example, in U.S. Pat. No. 3,962,513, laser beams and a transfer film are employed for producing lithographic printing plates. The energy of the laser is absorbed at solid particles that are contained in a bonding agent layer of nitrocellulose on the transfer film. The bonding agent thereby decomposes in the irradiated regions and plastic applied thereover can be transferred onto a substrate, for example aluminum, suitable for a printing plate.

A recording film is also disclosed by French Patent FR 2 250 318. This likewise comprises a nitrocellulose layer in which defined regions are decomposed with a laser, whereby an "image" is produced in the recording layer. The bonding agent is thereby subject to an auto-oxidation and burns completely. Solid particles contained in the bonding agent can thereby be transferred onto an adhesive tape.

The transferred constituents, however, do not represent an ink and are likewise not chemically bonded to or into a carrier phase but are dispersed in the bonding agent in a purely physical way or are arranged over the bonding agent in a further layer.

One possibility of releasing the ink constituent of the inking ribbon of the invention is comprised in the decomposition of the labile groups by radiation. Thus, for example, the azo group is unstable under ultraviolet light having a wavelength of 360 nm and decomposed while splitting off nitrogen. The energy required for the decomposition amounts to approximately 120 kJ/mol. A similar amount of energy is required for the decomposition of corresponding carboxylate groups that can also be triggered by infrared radiation in addition to heat. It is thereby possible to utilize the inking ribbon of the invention in printers whose printing heads do not effect the color transfer from the inking ribbon onto the paper by heat transfer but with ultraviolet or, respectively, infrared radiation.

The invention shall be set forth in yet greater detail below with reference to two exemplary embodiments.

FIRST EXEMPLARY EMBODIMENT

A polymerizable, olefinic monomer that carries an aromatic amine, for example p-amino-methacrylic benzyl ester is diazotized and is converted with an alkyl cyanoacetic ester according to formula 1 that carries a colorant X.

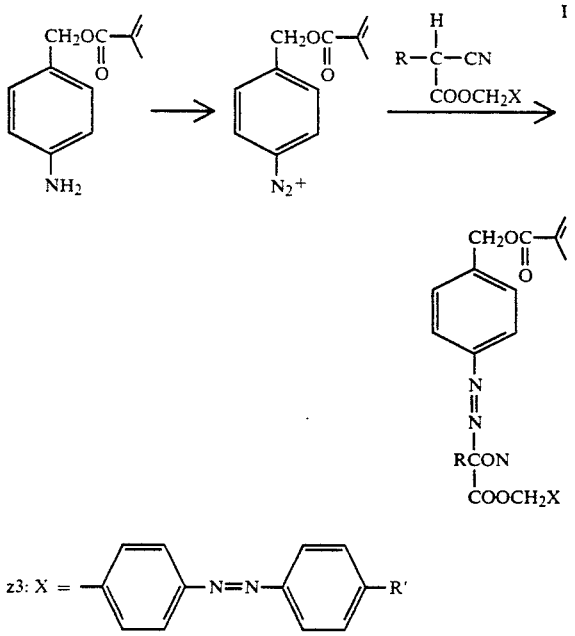

I z3: X =

The monomer I is subsequently polarized at about 60° in solution according to known methods. By mixing this polymer with, for example, powdered polyethylenevinylacetate and by subsequent co-extrusion, films having a thickness of, for example, 1 μm are produced therefrom and are then joined to a 2 μm thick polyethylene terephthalate film (carrier film). A paraffin layer that is up to about 2 μm thick can also then be deposited on this layer from solution. A ready-to-use printing film for an inking ribbon has arisen after drying.

For coating, a solution containing approximately 0.5 through 10% polymer by weight can also be utilized in a suitable solvent. In this case (given deposition of the layer from solution), a longer-chain alkyl radical R (for example R =hexyl) can serve as dissolving intermediary. Instead of the monomer, a poly-p-aminiostyrol can also be alternatively diazotized in a polymer-analogous conversion and can be converted with the cyan ester.

In the finished inking ribbon, the colorant is released when heated to approximately 120° C and is transferred onto the paper. It is thereby of particular advantage that heat is released upon decomposition of the azo group, this heat reducing the amount of energy needed for the decomposition or, respectively, for triggering the printing event.

SECOND EXEMPLARY EMBODIMENT

A depolymerizable polymer, for example poly-α-methylstyrol (ceiling temperature of about 60° C.) is dissolved in toluene and is applied onto the carrier film in a thickness of approximately 1 μm and is provided with a wax layer containing colorant. As in the first example, this is deposited from a solution that, however, also contains a colorant, for example lamp black, duasyn black or others. In a modification, this wax layer can also be eliminated when the colorant is directly dissolved in the polymer or is worked thereinto.

In addition to the poly-α-methylstyrol, there are also numerous other depolymerizable polymers having different decomposition temperatures that can be utilized as needed. Thus, for example, polymers of isophthalic acid and 1,4-dibromo tetrahydronaphthaline are known that decompose at about 120° C. under the influence of acid, whereby they are stable to above 200° C. without the influence of acid (in this respect, see J. M. J. Frechet, Emil Warburg Symposium, Elmau 1987, Conference Volume, page 73).

In this exemplary embodiment, the colorant transfer ensues on the basis of the thermally initiated decomposition of the intermediate layer or, respectively, on the basis of the decomposition of the polymer that represents the bonding agent of the layer containing the colorant.

We claim:

1. An inking ribbon for use in a transfer printing apparatus for printing a material to be printed by the designational application of radiation and/or heat, comprising:

a carrier film;

a colorant chemically bonded to or bonded into a carrier phase on the carrier film, said carrier phase including a labile material that chemically decomposes upon the application of radiation and/or heat to thereby chemically release at least one colorant transfer constituent by converting said at least one colorant transfer constituent into a mobile phase for transfer onto the material to be printed.

2. An inking ribbon according to claim 1, further comprising:

a labile group bonding said at least one colorant transfer constituent in the carrier phase, said labile group decomposing to release a gaseous compound.

3. An inking ribbon according to claim 2, wherein said labile group is of a material selected from a group consisting of: an azo group and a carboxylate group.

4. An inking ribbon according to claim 1, wherein said carrier phase comprises a carrier polymer chemically labile bonded to said at least one colorant transfer constituent.

5. An inking ribbon according to claim 4, wherein said carrier polymer is the carrier film of the inking ribbon.

6. An inking ribbon according to claim 1, further comprising:

further colorant constituents on said carrier film for transfer to the material to be printed; and said at least one colorant transfer constituent is chemically released from the carrier phase as a liquid under given conditions to form a solvent for the further colorant constituents to be transferred.

7. An inking ribbon according to claim 1, wherein the carrier phase is a polymer having a low depolymerization temperature, said polymer being of monomers of a plastic that have been polymerized in the presence of an ink constituent that at least comprises said at least one colorant transfer constituent.

8. An inking ribbon according to claim 1, wherein said at least one colorant transfer constituent is a first colorant transfer constituent and, further comprising:

a second colorant transfer constituent that is releasable from a carrier phase at a different temperature than said first colorant transfer constituent.

9. An inking ribbon according to claim 1, further comprising:

a further, thermally labile compound that releases at least one gas upon decomposition being provided on the carrier film.

10. An inking ribbon according to claim 9, wherein the further, thermally labile compound is azodicarbonamide.

* * * * *